United States Patent [19]

Gardner

[11] Patent Number: 4,718,859

[45] Date of Patent: Jan. 12, 1988

[54] ZERO INSERTION FORCE CONNECTOR FOR FLEXIBLE FLAT CABLE

[75] Inventor: Michael J. Gardner, Rochester Hills, Mich.

[73] Assignee: Molex Incorporated, Lisle, Ill.

[21] Appl. No.: 25,916

[22] Filed: Mar. 16, 1987

[51] Int. Cl.[4] ..... H01R 9/07

[52] U.S. Cl. ..... 439/329; 439/493; 439/495; 439/499; 439/635

[58] Field of Search ..... 439/325, 326, 329, 492, 439/493, 494, 495, 499, 634, 635, 636

[56] References Cited

U.S. PATENT DOCUMENTS

| | | | |
|---|---|---|---|
| 3,090,028 | 5/1963 | Hall et al. | 339/174 |
| 3,149,896 | 9/1964 | Hall | 339/75 |
| 3,701,071 | 10/1972 | Landman | 439/329 |
| 3,848,952 | 11/1974 | Tighe, Jr. | 439/326 |
| 3,989,336 | 11/1976 | Rizzio, Jr. et al. | 439/329 |
| 4,261,631 | 4/1981 | Guilcher et al. | 439/325 |
| 4,449,773 | 5/1984 | Esser et al. | 339/59 M |

*Primary Examiner*—John McQuade

*Attorney, Agent, or Firm*—John W. Cornell; Louis A. Hecht

[57] ABSTRACT

A zero insertion force connector is provided for flat cables having conductors on one or both sides. The ZIF connector includes a base having a plurality of generally parallel slots for receiving generally C-shaped portions of contacts with contact arms of unequal lengths. An actuator is slidably urged into contact with an initial fulcrum on the base. The actuator defines a cable channel into which the flat cable can be inserted such that the cable is guided between the arms of the C-shaped contacts. The actuator then is rotated about its initial fulcrum of the base, and the cable is urged into contact with anti-overstress fulcrums on the base. Continued rotation of the actuator urges the cable into the opposed arms of the contacts to make electrical connection. Resilient deflectable locking latches engage the actuator and hold the actuator into a fully seated condition.

16 Claims, 7 Drawing Figures

ZERO INSERTION FORCE CONNECTOR FOR FLEXIBLE FLAT CABLE

BACKGROUND OF THE INVENTION

Zero insertion force (ZIF) connectors are employed to reduce or eliminate the forces that would otherwise be imposed on a plug, cable or other electrical conductor as the conductor is being inserted into a connector. The elimination or reduction of these insertion forces is particularly essential for components having small contacts and/or conductive strips which could easily be damaged by forces encountered when making an electrical connection. ZIF connectors provide open channels which enable the fragile conductors to be placed substantially adjacent the contacts. The contacts and/or the conductors then are moved relative to one another to achieve the necessary electrical connection.

Many electronic devices employ flat flexible cables having a plurality of electrically conductive strips disposed in a parallel array. The conductive strips may be formed by thin wires, or an electrically conductive ink. The electrically conductive strips typically are covered by plastic to provide physical protection and electrical insulation. In certain embodiments, the electrically conductive strips may be disposed on both sides of a central plastic support and then are covered by outer plastic layers. In the typical situation a portion of the protective and insulating plastic is removed adjacent one or both ends of the cable to facilitate electrical connection. Many flat flexible cables are very thin (e.g. 0.004 inch to 0.014 inch) and therefore can be damaged easily when making an electrical connection. As a result, ZIF connectors often are employed with flat flexible cables.

The prior art ZIF connector for flat flexible cables typically has included flexible contacts and an actuator to physically abut and move each contact. One general type of prior art ZIF connector includes contacts having a pre-load alignment or bias that permits the unobstructed entrance of the flat flexible cable into its fully seated position. The actuator of this type of prior art ZIF connector then is moved to physically urge the contacts against the conductors of the flat flexible cable. One particularly effective version of this general type of ZIF connector is shown in U.S. Pat. No. 3,989,336 which issued to Rizzio, Jr., and Janzow on Nov. 2, 1976 and is assigned to the assignee of the subject application. Other ZIF connectors of this general type are shown in U.S. Pat. No. 3,090,028 which issued to Hall et al on May 14, 1963 and U.S. Pat. No. 3,149,896 which issued to Hall on Sept. 22, 1964.

Another type of prior art ZIF connector includes a contact which is pre-loaded into a position to engage a flat flexible cable. However, this type of ZIF connector includes an actuator that can open the contacts to provide an unobstructed passage for the flat flexible cable to enter. An example of this type of ZIF connector is shown in U.S. Pat. No. 4,449,773 which issued to Esser et al.

U.S. Pat. No. 3,701,071, which issued to Landman on Oct. 24, 1972, shows a ZIF connector where a circuit board is inserted into a hinged member which is rotated to bring one side of the circuit board into engagement with electrical contacts.

Prior art connectors also are available for cables or cards having conductors on two sides. The prior art connectors of this type have included a generally C-shaped contact, the arms of which are spaced from one another a distance greater than the thickness of the cable or card. The cable or card is inserted between the arms of the contacts, and an actuator is moved to urge the contact arms a controlled amount to make electrical connection with the flat cable or card.

U.S. Pat. No. 3,848,952, which issued to Tighe on Nov. 19, 1974, shows a connector having generally C-shaped contacts, with the arms of the "C" being slightly offset from one another. The connector of U.S. Pat. No. 3,848,952 is adapted specifically for a rigid card. The card is inserted into the ZIF contact at an angle and is then rotated to biasingly engage both of the arms of the C-shaped contact. The rigid board is then locked into the required alignment by structural components spaced from the connector.

Most of the above described ZIF connectors, and in particular those having an actuator to move the contacts, are limited to cables having a prespecified thickness. Improper electrical connection may result if a cable of lesser thickness is employed. Conversely, the contacts, the cable or the connector housing may be damaged if a thicker than specified cable is employed.

In view of the above, it is an object of the subject invention to provide a ZIF connector that can accept flat cables of various thicknesses.

It is another object of the subject invention to provide a ZIF connector that can be used with flat cables having conductors on one or both sides.

It is an additional object of the subject invention to provide a ZIF connector that enables positive connection with a flat cable without urging the contacts toward the flat cable.

A further object of the subject invention is to provide a ZIF connector which effectively prevents damage to the contacts.

SUMMARY OF THE INVENTION

The ZIF connector of the subject invention includes a base, a plurality of contacts securely mounted in the base, and an actuator which is pivotable relative to the base. The contacts are disposed and configured to contact both opposed sides of a flat flexible cable. However, the contacts do not contact the flat cable at locations directly opposite one another. Rather, the contacts are configured to contact the opposed sides of the flat cable at locations that are spaced from one another along the length of the cable. Preferably, each contact includes a C-shaped portion which comprises a pair of opposed contact arms of unequal length.

The base includes means for receiving the contacts. For example, the base may include slots into which at least portions of the respective contacts are disposed. In a preferred embodiment, as described below, the base includes a plurality of generally parallel slots into which the C-shaped portions of the respective contacts are disposed.

The base further includes a plurality of fulcrums about which the actuator may pivot. In particular, the base may include an initial fulcrum against which the actuator is positioned in a pre-load position and about which the actuator initially pivots. The initial fulcrum of the base is not fixedly connected to the actuator. Thus, the initial fulcrum of the base will function as a pivot only during the initial movement of the actuator relative to the base, as explained in detail below.

The base further includes at least one anti-overstress fulcrum which is disposed to prevent excessive and potentially damaging stress on one arm of each contact. The anti-overstress fulcrum may be generally linear and is disposed on the base to be contacted by the flat cable during the pivoting of the actuator about the initial fulcrum. The actual angular position of the actuator at which the anti-overstress fulcrum contacts the flat cable will depend upon the thickness of the flat cable. Thicker flat cables will contact the anti-overstress fulcrum sooner than thinner flat cables. The anti-overstress fulcrum will then become the point or line about which the actuator pivots relative to the base housing, and the initial fulcrum will translate relative to the actuator.

The base may further comprise an anti-overstress surface which is disposed to prevent excessive and potentially damaging stress on the second contact arm of each contact. The anti-overstress surface may be parallel and spaced from the anti-overstress fulcrum. An actuator channel is defined generally between the anti-overstress fulcrum and the anti-overstress surface for receiving at least the portion of an actuator in which the cable is disposed.

The base may further comprise guide means for properly aligning the actuator to the base, and locking arms to securely lock the actuator into a position where the flat cable will be in electrical connection with the contacts. The base may further be provided with tabs for mechanically engaging portions of the flat cable to achieve strain relief.

The actuator is dimensioned to pivotally move relative to the base. More particularly, the actuator includes spaced apart top and bottom supports which define an elongated slot with an opening dimensioned to receive the thickest flat cable with which the subject ZIF connector may be employed. The entrance to the slot in the actuator preferably is flared to facilitate positioning of the flat cable therein.

The actuator may include channels, rails or other guide means for guiding the actuator into proper position relative to the base housing. The actuator includes an initial stop which will engage the initial fulcrum of the housing, and about which the actuator will rotate relative to the initial fulcrum of the base housing. As noted above, this rotation of the actuator about the initial fulcrum will urge the flat cable toward the anti-overstress fulcrum of the base.

As the actuator and the base are advanced toward the fully seated position, the opposed sides of the flat cable will be urged into contact with the respective arms of the contact. These arms of the contact will be biased outwardly and away from one another to create a normal force on the conductors of the flat cable, thereby achieving the required electrical connection. The anti-overstress pivot point positively limits the magnitude of the deformation of the contact arms to ensure that the contact arms are not overstressed and thereby damaged. In the fully seated position, the actuator ensures that the cable is urged into contact with both arms of the C-shaped contact.

The actuator further comprises locking means for securely engaging the base, and keeping the actuator in the fully seated position.

DETAILED DESCRIPTION OF THE PREFERRED EMBODIMENT

Figure 1:
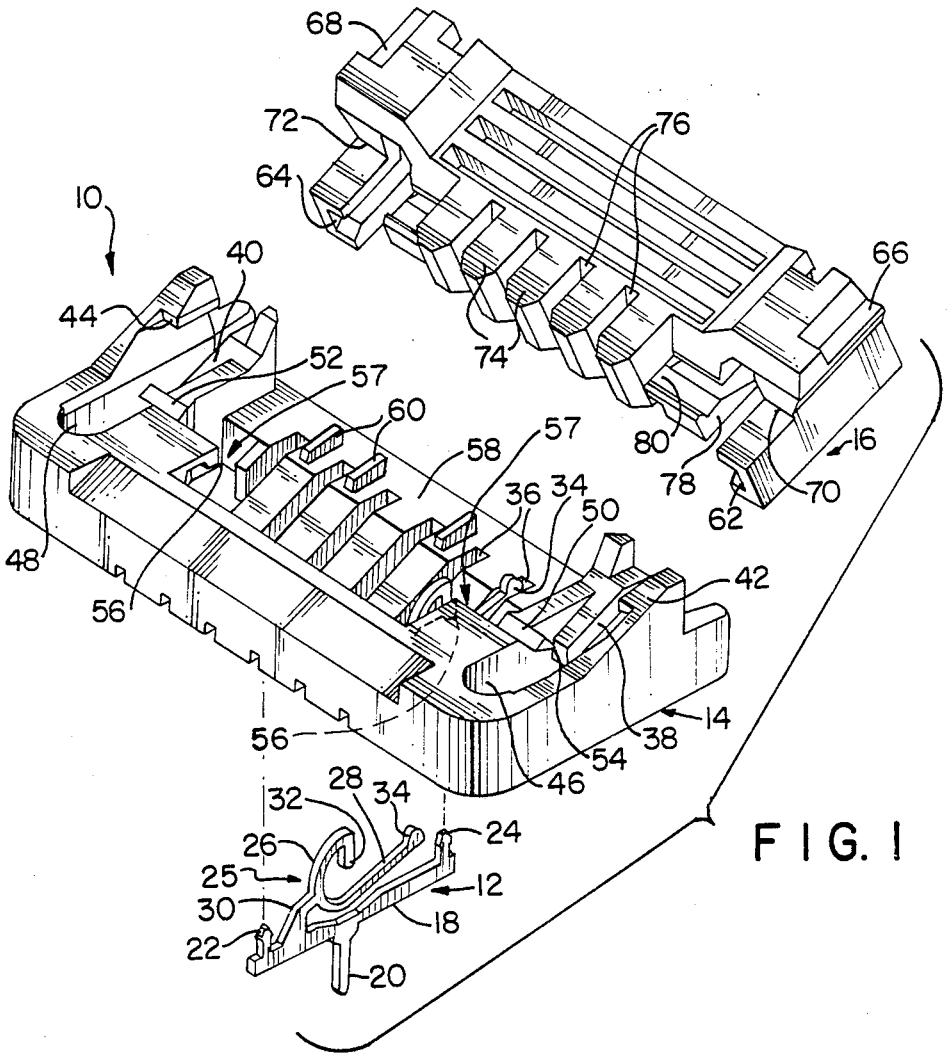
FIG. 1 is an exploded perspective view of the ZIF connector of the subject invention.

The ZIF connector of the subject invention is indicated generally by the numeral 10 in FIG. 1. The ZIF connector 10 includes a plurality of electrical contacts 12, a base 14 into which the contacts 12 may be mounted, and an actuator 16 which may be slid and then pivoted into engagement with the base 14.

Each contact 12 includes an elongated base 18 having a downwardly extending solder tail 20 and a pair of upwardly extending mounting studs 22 and 24. The solder tail 20 is dimensioned to extend through an aperture in a circuit board, or the like and to enable electrical connection with appropriate electrical circuitry. (not shown). The mounting studs 22 and 24 are dimensioned to securely engage mounting apertures on the base 14, as explained further below. Although contacts 12 are shown with solder tails 20, surface-mount type contact configurations may also be employed to electrically engage printed circuit board contact pads or circuits.

The contact 12 further includes a C-shaped portion 25 having contact arms 26 and 28. The C-shaped portion 25 extends from a support arm 30 which in turn extends from the elongated base 18. The contact arms 26 and 28 and the support arm 30 all exhibit a resiliency which contribute to the effectiveness of the ZIF connector 10, as explained further below. Contact arm 28 is considerably longer than the contact arm 26, to ensure that the respective contact arms 26 and 28 will make electrical contact at spaced apart locations along the length of a flat cable. The contact arms 26 and 28 terminate at contact points 32 and 34.

The contact 12 is configured and dimensioned such that a flat cable of the maximum anticipated thickness and the bottom supporting member of the actuator 16 can be inserted generally parallel to the contact arm 28 and between the contact arms 26 and 28 without touching either contact point 32 or contact point 34. However, the configuration and dimensions of the contact 12 are such that when the thinnest flat cable to be employed with the ZIF connector 10 is rotated into a position generally parallel to the elongated base 18, the flat cable will contact both contact points 32 and 34.

The base 14 is of generally elongated rectangular configuration and includes a plurality of generally parallel slots 36, each of which is dimensioned to receive the C-shaped portion 25 of a contact 12. The base 14 further includes guide rails 38 and 40 which guide the actuator 16 into a proper pre-load position with respect to the base 14. Resilient locking latches 42 and 44 are spaced from the guide rails 38 and 40 and are configured to biasingly engage corresponding portions of the actuator 16, as explained below, to securely retain the actuator 16 in a closed position relative to the base 14. The resilient locking latches 42 and 44 also function to keep the actuator 16 in the proper angularly aligned pre-load position relative to the contacts 12 and the base 14.

The guide rails 38 and 40 extend respectively into recesses 46 and 48 of base 14. The recesses 46 and 48 provide room for guide channels on the actuator 16 to pivot. The base 14 further includes fulcrum arms 50 and 52 which are cantilevered into the recesses 46 and 48 respectively. Each fulcrum arm 50, 52 is of generally triangular cross section and includes an edge 54 which defines an initial fulcrum about which the actuator 16 will initially rotate relative to the base 14. The base 14 further includes anti-overstress fulcrums 56 which define edges about which the flat cable and actuator 16 will rotate after the initial rotation about fulcrum arms 50 and 52. As shown in FIG. 1, two collinear anti-overstress fulcrums 56 are provided. However, additional anti-overstress fulcrums may be provided on ZIF connectors for wide cables to prevent bowing of the actuator.

The base 14 is provided with a generally planar anti-overstress surface 58 toward which the flat cable will be urged in the fully seated condition of ZIF connector 10. The anti-overstress surface 58 is substantially parallel to the anti-overstress fulcrum 56 so as to define an actuator channel 57 therebetween. The dimensions of the base 14 enable the second contact point 34 of each contact 12 to extend above the planar anti-overstress surface 58. Strain relief tabs 60 may extend upwardly from the planar surface 58 of the base 14. The strain relief tabs 60 will be dimensioned and disposed to engage corresponding notches formed adjacent the end of the flat cable to enable a secure connection with minimum stress on the cable and/or the contacts 12 of the ZIP connector 10.

Figure 2:
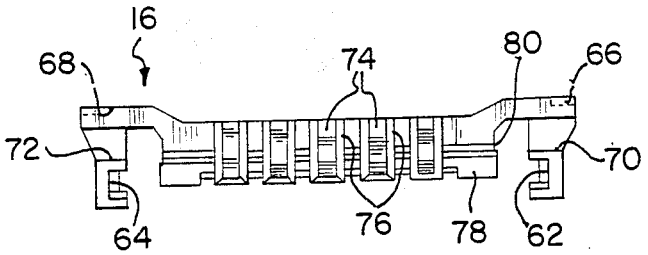
FIG. 2 is a front elevational view of the actuator of the ZIF connector of the subject invention.

The actuator 16 as shown in FIGS. 1 and 2 includes a pair of opposed guide channels 62 and 64 which are disposed and dimensioned to slidably engage the guide rails 38 and 40 of the base 14, and to be slidably received within the recesses 46 and 48 of the base 14. The guide rails 38, 40 and the guide channels 62, 64 are aligned to ensure that the cable and the bottom support of the actuator 16 will be guided between the contact points 32 and 34 of contacts 12 with no potentially damaging physical impact. The actuator 16 is further provided with locking ledges 66 and 68 which are disposed to be engaged by the resilient locking latches 42 and 44 respectively of the base 14 when the actuator 16 and the base 14 are fully seated relative to one another.

The portion of actuator 16 between guide channel 62 and the locking ledge 66 defines an inwardly extending initial stop 70. Similarly, an inwardly extending initial stop 72 is defined between the guide channel 64 and the locking ledge 68. The inwardly extending initial stops 70 and 72 of actuator 16 will engage the fulcrum arms 50 and 52 of base 14 to partly define a pre-load position of ZIF connector 10 and to define the line about which the actuator 16 initially pivots relative to the base.

The leading face of the actuator 16 is provided with a plurality of spaced apart cable supports 74 which define slots 76 therebetween. The slots 76 between the adjacent cable supports 74 are disposed to align with the slots 36 in the base 14 and to receive portions of each respective contact 12. The supports 74 will effectively protect each contact 12 from damage caused by inadvertent physical impact. The supports 74 also provide the forward and top support for the flat cable to be employed with the ZIF connector 10. A bottom support 78 extends substantially the entire width of the cable to be employed with the ZIF connector 10 and is spaced from supports 74 by a distance substantially equal to the maximum thickness of any flat cable which may be used with the ZIF connector 10. As a result of this spacing between the supports 74 and the bottom support 78, a cable receiving slot 80 is defined extending into the rear side of the actuator 16. The bottom support 78 is dimensioned to ensure that physical impact between the bottom support 78 and the contact point 34 is avoided when the actuator 16 is slid into position in the base 14.

Figure 3:
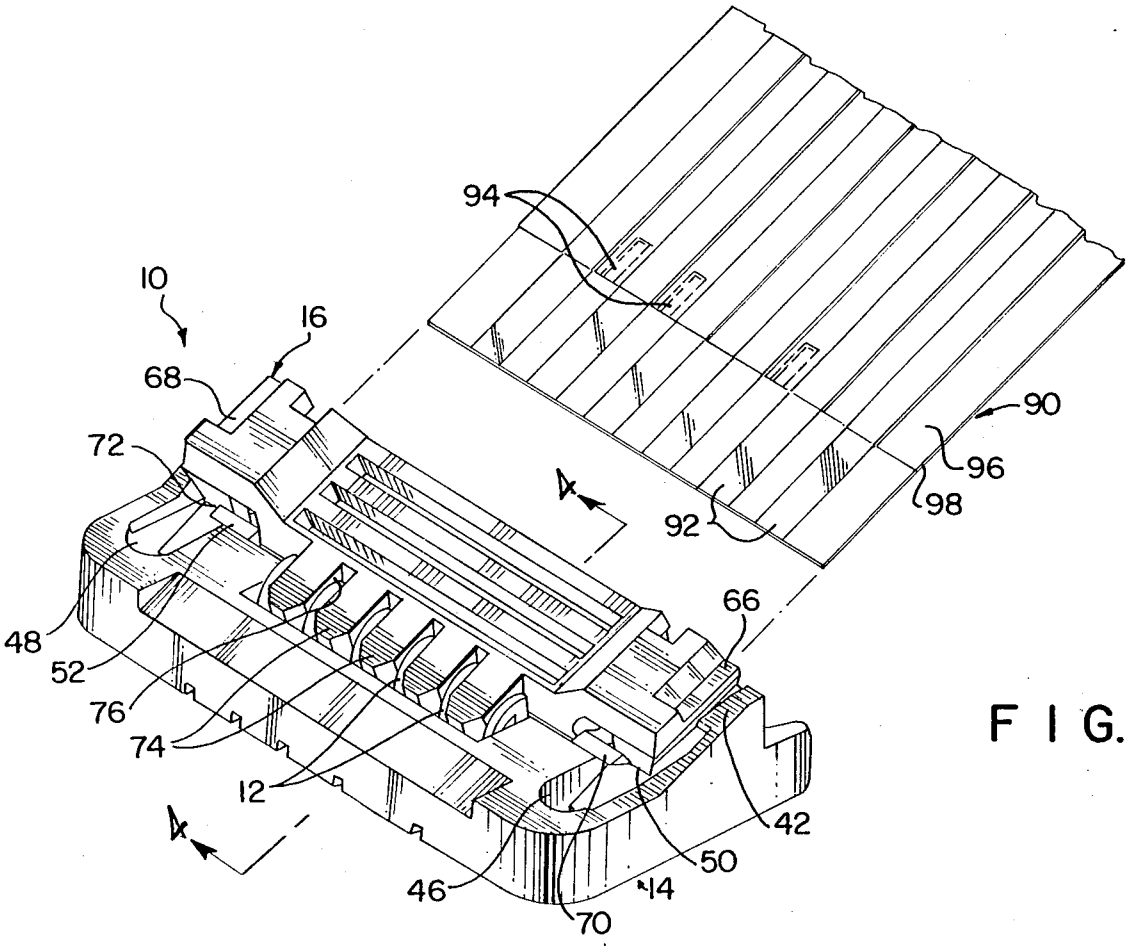
FIG. 3 is a perspective view of the ZIF connector in an assembled but opened condition.
Figure 4:
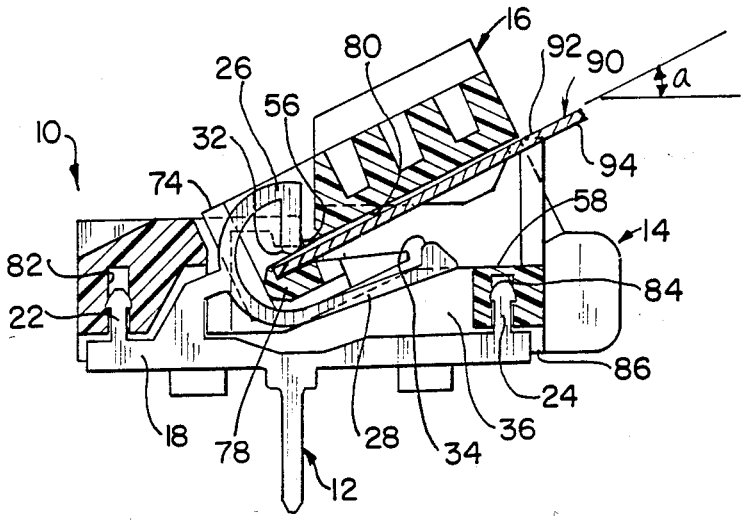
FIG. 4 is a cross-sectional view taken along line 4—4 in FIG. 3.

The ZIF connector 10 is assembled as shown in FIGS. 3 and 4. More particularly, the mounting studs 22 and 24 of contacts 12 are urged upwardly into the mounting apertures 82 and 84 in the bottom surface 86 of the base 14. In this mounted position, the contact arms 26 and 28 will extend into the associated slots 36 of the base 14. Additionally, the contact point 32 of contact arm 26 will extend below the anti-overstress fulcrum 56, while the contact point 34 on contact arm 28 will extend above the anti-overstress surface 58.

The actuator 16 is then urged into position on the base 14 such that the guide channels 62 and 64 of the actuator 16 slidably engage the guide rails 38 and 40 of the base 14. The slidable advancement of the guide channels 62 and 64 along the guide rails 38 and 40 will be terminated when the inwardly extending initial stops 70 and 72 of the actuator 16 abut the initial fulcrum arms 50 and 52 of the base 14. In this initial pre-loaded condition, the actuator 16 will be disposed at an angle "a" relative to the support 18 of each contact 12 of approximately 25°, as shown in FIG. 4, and the supports 74 will be disposed in the actuator channel 57 of base 14. FIG. 4 also shows that in this pre-load condition, an outwardly flared and readily accessible cable channel 80 is defined between the top supports 74 and the bottom support 78. Furthermore, when the actuator 16 is at the pre-load angle "a", the top supports 74 protect the contact points 32 from inadvertent and possibly damaging contact with a cable 90 being inserted into the cable channel 80. Additionally, the outwardly flared cable channel 80 is sufficiently wide adjacent the contact points 34 to make inadvertent and potentially damaging impact with contact points 34 by a cable 90 unlikely.

As shown in FIG. 3, a cable 90 having conductive strips 92 is slidably inserted into the channel 80. The cable 90 may include cut outs 94 to engage the strain relief tabs 60 on the base 14. Once the cable 90 has been fully seated in the cable channel 80, the actuator 16 is rotated downwardly toward the base 14 and relative to the fulcrum arms 50 and 52. This rotation of the actuator 16 will move the end of flat cable 90 upwardly and toward the anti-overstress fulcrums 56. The relative rotational position at which the cable 90 will contact the anti-overstress fulcrums 56 will depend upon the thickness of the cable 90. A thicker cable 90 will contact the anti-overstress fulcrum 56 earlier than a thinner cable 90.

Once contact is established between the cable 90 and the anti-overstress fulcrum 56, this point of contact will define a new pivot line for the rotation of the actuator 16 relative to the base 14. Furthermore, the fulcrum arms 50 and 52 will then move away from the inwardly extending initial stops 70 and 72. Continued rotation of the actuator 16 relative to the base 14 will urge the top side 96 of flat cable 90 into the contact point 32 and will urge the bottom side 98 of the flat cable 90 into the contact point 34. As the actuator 16 approaches its fully seated position relative to the base 14, the contact points 32 and 34 will be biased out of their initial unloaded positions to create normal forces on the opposed sides 96 and 98 of the flat cable 90. As this fully seated position of the actuator 16 relative to the base 14 is approached, the resilient deflectable locking latches 42 and 44 of the base 14 will be urged outwardly and then will snap into engagement with the locking ledges 66 and 68 on the actuator 16.

Figure 5:
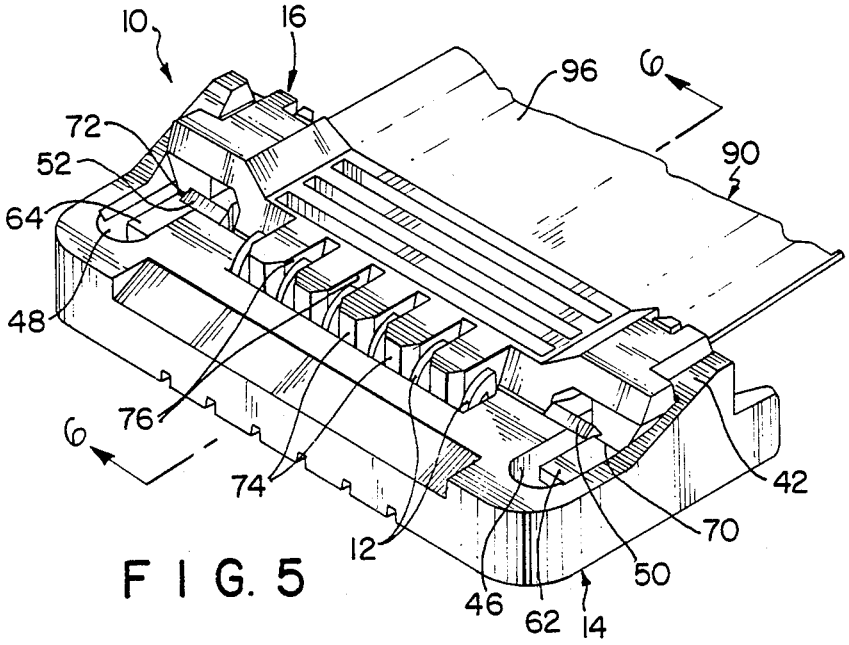
FIG. 5 is a perspective view of the assembled ZIF connector in a closed condition.
Figure 6:
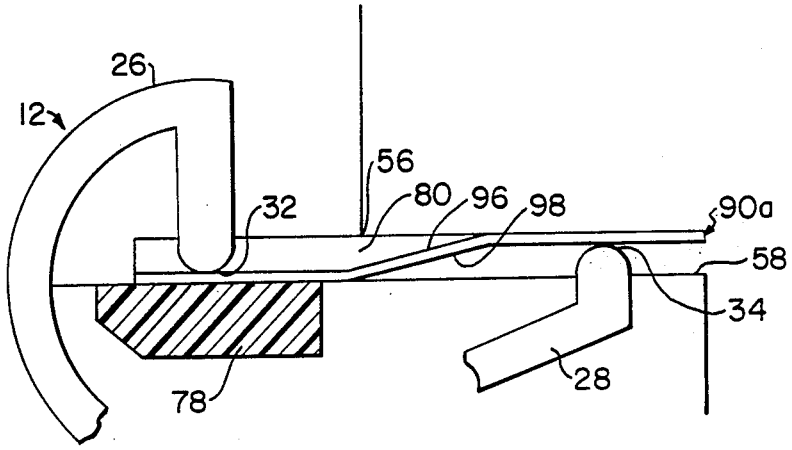
FIG. 6 is a cross-sectional view taken along line 6—6 in FIG. 5.
Figure 7:
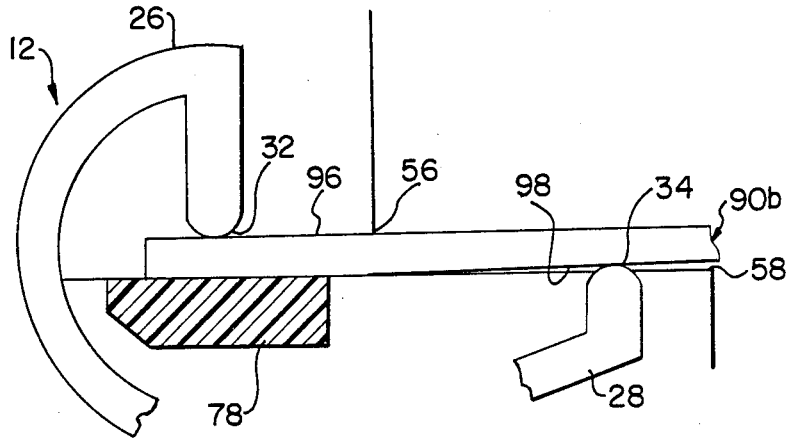
FIG. 7 is a cross-sectional view similar to FIG. 6 but showing a different dimension cable.

The fully seated and locked condition of the ZIF connector 10 is illustrated in FIGS. 5–7. More particularly, FIG. 6 illustrates the relative positions of the contact arms 26 and 28 and the respective contact points 32 and 34 with a thin cable 90*a* having a thickness of approximately 0.004 inch.

FIG. 7 shows the relative deformation of the contact arms 26 and 28 and the contact points 32 and 34 when employed with a relatively thick cable having a thickness of approximately 0.014 inch. In each case, the contact arms 26 and 28 will undergo deflection in response to the presence of the cable 90*a*, 90*b* and will create a sufficient normal force on the cable for achieving positive electrical connection. However, in each case excessive deflection of contact arms 26 and 28 is prevented by the anti-overstress fulcrum 56 and the anti-overstress surface 58.

In summary, a ZIF connector is provided for flat cables of varying thicknesses. The ZIF connector of the subject invention includes a base having a plurality of generally parallel slots for receiving generally C-shaped portions of contacts. The C-shaped portion of each contact includes a pair of contact arms of unequal length. The base includes a pair of initial fulcrum arms against which an actuator is initially positioned and about which the actuator initially pivots. The base further includes a pair of anti-overstress fulcrums into which the flat cable is urged and which define a second fulcrum about which the actuator rotates. The actuator includes a plurality of spaced apart top supports and a bottom support spaced from the top supports and defining a cable channel therebetween. The top supports are spaced from one another to define slots which are registrable with the contacts of the ZIF connector. The base and the actuator are provided with mating channels and rails to enable the actuator to be slidably disposed relative to the base at a predetermined angle. The cable is slidably inserted into the cable channel of the actuator, and the actuator is rotated toward a fully seated position. The initial rotation of the actuator is about the initial fulcrum arms of the base. The flat cable is then advanced toward the anti-overstress fulcrum which then becomes the second pivot about which the actuator rotates. Continued rotation of the actuator urges the exposed conductors of the flat cable into mated electrical engagement with the two respective contact points of each contact.

While the invention has been described with respect to certain preferred embodiments, it is apparent that certain modifications can be made without departing from the scope of the invention as defined by the appended claims.

I claim:

1. A zero insertion force connector for a flat cable, said cable having opposed top and bottom surfaces, said connector comprising:

a base comprising an initial fulcrum, an actuator channel and an anti-overstress fulcrum;

a plurality of electrical contacts mounted to said base, each said contact including first and second contact arms terminating respectively at first and second spaced apart contact points, said contact points being disposed within the actuator channel of said base; and an actuator having a cable channel for receiving a flat cable therein, said actuator being dimensioned to be inserted in the actuator channel of said base, said actuator including an initial stop engageable with the initial fulcrum of said base when said actuator is disposed within the actuator channel of the base, said actuator being pivotable about the engagement between said initial stop and said initial fulcrum to urge said cable into contact with said anti-overstress fulcrum of said base, said actuator and said flat cable being further pivotable about said anti-overstress fulcrum to urge the top and bottom surfaces of said flat cable into said first and second contact points respectively.

2. A zero insertion force connector as in claim 1 wherein the base further includes at least one guide rail and wherein said actuator further includes at least one guide channel engageable with said guide rail of said base.

3. A zero insertion force connector as in claim 2 wherein the base further defines a recess generally adjacent the guide rail thereof, said recess being dimensioned to receive the guide channel of said actuator.

4. A zero insertion force connector as in claim 3 wherein the initial stop of the actuator defines a generally inwardly extending corner engageable with the initial fulcrum of said base.

5. A zero insertion force connector as in claim 4 wherein the initial fulcrum defines a fulcrum arm cantilevered into the recess of said base.

6. A zero insertion force connector as in claim 1 wherein the base comprises a plurality of spaced apart generally parallel slots for receiving the contact arms of said contacts.

7. A zero insertion force connector as in claim 6 wherein the actuator comprises a plurality of spaced apart top supports defining a plurality of slots therebetween, said top supports defining a portion of said cable channel, the slots between the top supports of said actuator being substantially in line with the slots in said base and being dimensioned to receive at least one said contact arm of said contact.

8. A zero insertion force connector as in claim 7 wherein said actuator further comprises a bottom support spaced from said top supports and further defining said cable channel.

9. A zero insertion force connector as in claim 1 wherein the anti-overstress fulcrum is generally linear.

10. A zero insertion force connector as in claim 9 wherein the anti-overstress fulcrum is disposed at two spaced apart locations adjacent said actuator channel.

11. A zero insertion force connector as in claim 10 wherein said base further comprises an anti-overstress surface extending generally parallel to and spaced from said anti-overstress fulcrum, said anti-overstress surface defining a portion of said actuator channel.

12. A zero insertion force connector as in claim 1 wherein said base further comprises at least one strain relief tab extending into said actuator channel, and wherein the flat cable is provided with a corresponding number of notched apertures for engaging the strain relief tab.

13. A zero insertion force connector as in claim 1 wherein the base further comprises at least one resilient deflectable locking latch, and wherein the actuator further comprises at least one locking ledge engageable with said locking latch.

14. A zero insertion force connector as in claim 1 wherein the contact arms of said contact are of unequal length.

15. A zero insertion force connector as in claim 13 wherein the contact arms of said contact define a generally C-shaped portion, said contact further comprising an elongated base and a support arm extending between and connecting said C-shaped portion to said base.

16. A zero insertion force connector for a flat cable, said cable having opposed top and bottom surfaces, said connector comprising:

a base comprising an initial fulcrum, an actuator channel and an anti-overstress fulcrum adjacent to and partly defining said actuator channel;

a plurality of electrical contacts mounted to said base, each said contact including spaced apart first and second contact arms terminating respectively at first and second spaced apart contact points, said contact points being disposed within the actuator channel of said base; and an actuator comprising spaced apart top and bottom cable supports defining a channel for receiving a flat cable therebetween, said top and bottom cable supports being dimensioned to be inserted in the actuator channel of said base, said actuator including an initial stop engageable with the initial fulcrum of said base when said top and bottom supports are disposed within the actuator channel of the base, said actuator being pivotable about the engagement between said initial stop and said initial fulcrum to urge said cable into contact with said anti-overstress fulcrum of said base, said actuator and said flat cable being further pivotable about said anti-overstress fulcrum to urge the top and bottom surfaces of said flat cable into said first and second contact points respectively.

* * * * *